US010188920B2

(12) United States Patent
Moloney

(10) Patent No.: US 10,188,920 B2
(45) Date of Patent: Jan. 29, 2019

(54) SCORING DEVICE FOR SCORING A SNOWBALL FIGHT

(71) Applicant: Peter Moloney, St. Paul, MN (US)

(72) Inventor: Peter Moloney, St. Paul, MN (US)

(73) Assignee: Peter Moloney, St. Paul, MN (US)

( * ) Notice: Subject to any disclaimer, the term of this patent is extended or adjusted under 35 U.S.C. 154(b) by 0 days.

(21) Appl. No.: 15/881,842

(22) Filed: Jan. 29, 2018

(65) Prior Publication Data

US 2018/0147465 A1 May 31, 2018

Related U.S. Application Data

(63) Continuation of application No. 15/222,044, filed on Jul. 28, 2016, now Pat. No. 9,901,799.

(51) Int. Cl.
*A63B 63/00* (2006.01)
*A63B 63/06* (2006.01)
(Continued)

(52) U.S. Cl.
CPC ..... *A63B 63/00* (2013.01); *A63B 63/06* (2013.01); *A63B 71/0669* (2013.01); *A63F 11/0051* (2013.01); *A63B 71/02* (2013.01); *A63B 2071/0661* (2013.01); *A63B 2071/0694* (2013.01); *A63B 2207/02* (2013.01); *A63B 2210/50* (2013.01); *A63B 2220/75* (2013.01); *A63F 2250/0407* (2013.01); *A63F 2250/0414* (2013.01); *A63F 2250/0428* (2013.01); *A63F 2250/49* (2013.01)

(58) Field of Classification Search
CPC ..... A63F 2250/0428; A63F 2250/0407; A63F 2250/0414; A63B 67/00
USPC ..... 273/349, 350, 398–402
See application file for complete search history.

(56) References Cited

U.S. PATENT DOCUMENTS 4,077,629 A 3/1978 Chestney
4,743,030 A * 5/1988 Auer ..... A63F 3/0685 222/79

(Continued)

OTHER PUBLICATIONS

International Patent Application No. PCT/US2017/044377, International Search Report and Written Opinion dated Oct. 13, 2017, 8 pages.

(Continued)

*Primary Examiner* — Mark Graham
(74) *Attorney, Agent, or Firm* — Fredrikson & Byron, P.A.

(57) ABSTRACT

A scoring device for scoring a snowball fight. The device worn by a person has a target portion and a scoring chamber portion. The target portion includes a target, and the scoring chamber portion is coupled below the target portion and is arranged to accumulate and store snow falling from the target portion. In some embodiments the target portion also includes a permeable layer coupled to the target in a spaced apart construction to form an interior region between the permeable layer and the target, the permeable layer configured to allow snow from snowballs to pass through the permeable layer and into the interior region before falling into the scoring chamber portion. In some embodiments a stopper element at least partially separates the target portion from the scoring chamber portion, to limit the amount of snow that exits the scoring chamber portion when the person bends over.

14 Claims, 6 Drawing Sheets

(51) Int. Cl.

| | |
|---|---|
| ***A63B 71/06*** | (2006.01) |
| ***A63F 11/00*** | (2006.01) |
| *A63B 71/02* | (2006.01) |

(56) References Cited

U.S. PATENT DOCUMENTS

| | | | | |
|---|---|---|---|---|
| 5,411,269 | A * | 5/1995 | Thomas | A63F 9/02 273/349 |
| 5,435,569 | A | 7/1995 | Zilliox | |
| 5,626,343 | A | 5/1997 | Sanders | |
| 5,819,998 | A | 10/1998 | Chehebar | |
| 5,865,438 | A | 2/1999 | Zilliox | |
| 6,416,853 | B1 | 7/2002 | Nakashima et al. | |
| 6,851,675 | B1 | 2/2005 | Jakubec et al. | |
| 7,815,429 | B1 | 10/2010 | Clark, Jr. | |

OTHER PUBLICATIONS

"Motivation for Snowball League", retrieved at https://www.youtube.com/watch?v=LAakAMYERmU, Dec. 8, 2014, 2 pages.
"Game Theory: Snowball League", retrieved at https://www.youtube.com/watch?v=Lme9w0CVtGI, Feb. 17, 2015, 2 pages.

* cited by examiner 100
124
156
160
134
α
140
122
132
120
130
150
154

120a
130a
120d
136
A
A'
152
120c
120e
110
100
140
120b

SCORING DEVICE FOR SCORING A SNOWBALL FIGHT

CROSS REFERENCE TO RELATED APPLICATION

This application is a continuation application of U.S. patent application Ser. No. 15/222,044, filed Jul. 28, 2016 and titled "SCORING DEVICE AND METHODS FOR SCORING A SNOWBALL FIGHT." The entire content of this application is incorporated herein by reference.

FIELD

This disclosure generally relates to a device for scoring a snowball fight and methods of scoring a snowball fight. The device and methods described herein provide a way to assess the amount of snow or other scoring media that has impacted a player.

BACKGROUND

Snowball fights are a well-known pastime, but snowball fights are chaotic and there is traditionally no easy way to score the game.

SUMMARY

A scoring device and methods of scoring described herein bring order to the game. The scoring device and methods provide a way to assess (e.g., measure, estimate, quantify) how much snow has impacted the player wearing the device.

An illustrative embodiment of a scoring device worn by a person includes a target portion and a scoring chamber portion. The target portion includes a target. The scoring chamber portion is coupled below the target portion and is arranged to accumulate and store snow falling from the target portion. In some embodiments the target portion also includes a permeable layer coupled to the target in a spaced apart construction to form an interior region between the permeable layer and the target, the permeable layer configured to allow snow from snowballs to pass through the permeable layer and into the interior region before falling into the scoring chamber portion.

In another illustrative embodiment of a scoring device worn by a person, the scoring device has a target portion and a scoring chamber portion. The target portion includes a target. The scoring chamber portion is coupled below the target portion and is arranged to accumulate and store snow falling from the target portion. A stopper element at least partially separates the target portion from the scoring chamber portion, to limit the amount of snow that exits the scoring chamber portion when the person moves, such as when the person bends over.

In an illustrative embodiment, the disclosure provides a method of scoring a snowball fight using one of the scoring devices described herein. The method includes receiving and wearing the scoring device; throwing snowballs at the scoring device such that snow from the snowballs enters the target portion; accumulating snow falling from the target portion in the scoring chamber portion; measuring the amount of snow accumulated in the scoring chamber portion; and determining a score.

The present disclosure resolves problems with scoring a snowball fight and brings organization to the game making it easier to determine a winner or winners.

The details of one or more examples are set forth in the accompanying drawings and the description below. Other features, objects, and advantages will be apparent from the description and drawings, and from the claims.

DETAILED DESCRIPTION

Figure 1A:
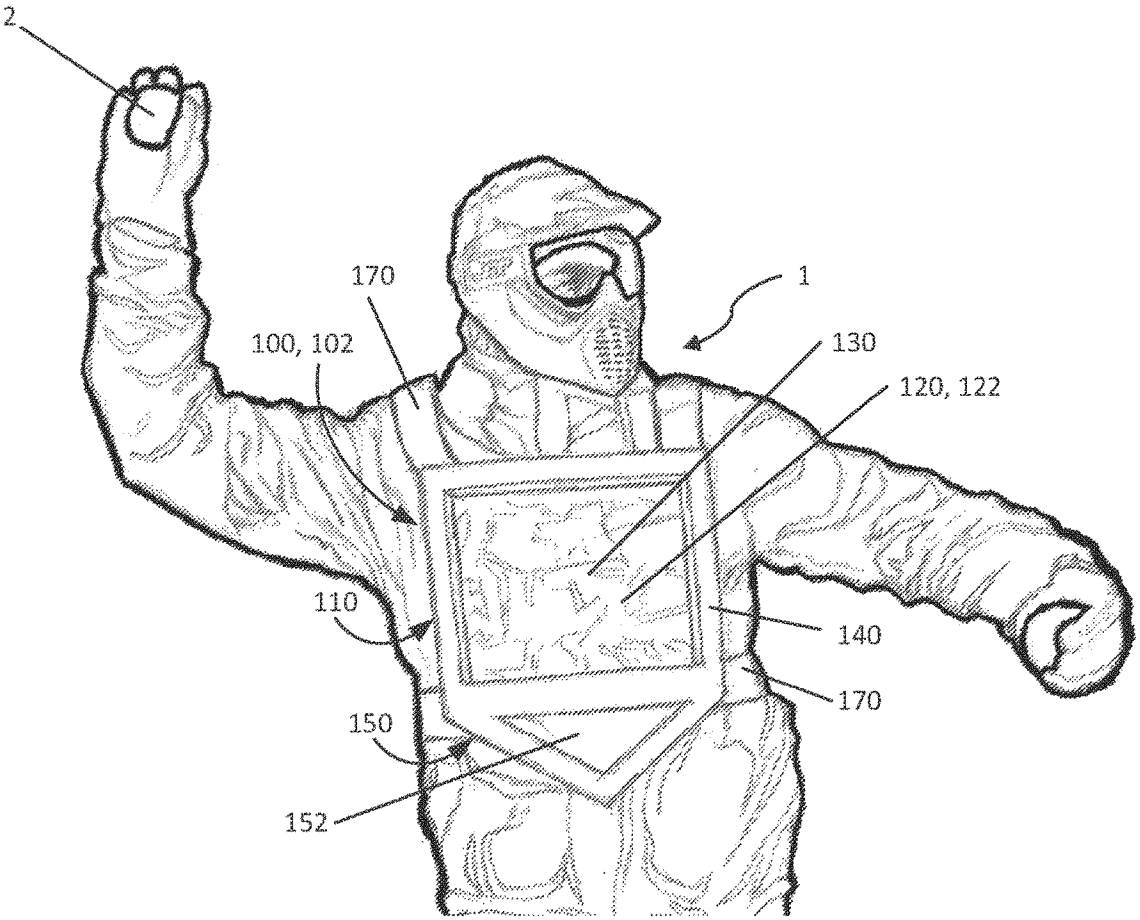
FIG. 1*a* is a front view of an illustrative embodiment of a scoring device worn by a person.

The following detailed description is exemplary in nature and is not intended to limit the scope, applicability or configuration of the disclosure in any way. Rather, the following description provides practical illustrations for implementing illustrative embodiments of the disclosure. It is to be understood that other embodiments may be utilized and structural changes may be made without departing from the scope of the disclosure.

Exemplary apparatus (e.g., device) and methods shall be described with reference to FIGS. 1-5. It will be apparent to one skilled in the art that elements from one embodiment may be used in combination with elements of the other embodiments, and that possible embodiments of such apparatus and methods using combinations of features set forth herein is not limited to the specific embodiments shown in the figures and/or described in the figures. Further, it will be recognized that the embodiments described herein may include elements which are not necessarily shown to scale. Still further, it will be recognized that the size and shape of various elements herein may be modified and still fall within the scope of the present disclosure, although certain one or more shapes and/or sizes, or types of elements, may be advantageous over others.

The disclosure provides an advantageous scoring device and method of scoring a snowball fight. Such recreational games may involve a player throwing snowballs by hand, although other means of "throwing" snow and cause the snow to become a projectile may be used other than by hand. The snowball fight may be played as a two-player game, or by more than two players with each playing as individuals, or as a team sport between two or more teams. The illustrative scoring device provides a way for players to determine a winner or winners. The winner being the player or team that has been impacted (e.g., hit) with the least amount of snow, or the team that has hit the other team with the most amount of snow. The scoring device may be provided as a wearable garment of a vest-like construction, a sports jersey, a shirt, a jacket, shorts, or similar sportswear to be worn while playing a game of snowball fight.

As shown in FIGS. 1*a*, 1*b*, 2*a*, 2*b* and 3, a scoring device 100 includes: a target portion 110 for an opponent to aim towards, and a scoring chamber portion 150 coupled below the target portion 110. The scoring chamber portion 150 arranged to catch and collect scoring media 2 (e.g., snow) that has entered the target portion 110 and is falling from the target portion 110. One or more attachment elements 170 may also be included in the scoring device 100 and arranged to attach the device to a person 1 (e.g., a player).

Generally, the target portion 110 is the location on the scoring device 100 (herein referred to as the device) that an opponent aims to hit with a snowball 2. After the snowball 2 hits the target portion 110, the snowball 2, or at least portions of the snowball 2, may fall into the scoring chamber portion 150. The benefit of this arrangement is that it allows the users a way to collect at least a portion of the snowballs 2 that impact an opponent in order to score a snowball fight.

As shown in the illustrative embodiment of FIGS. 1-4, the target portion 110 may include a target 120. The target 120 having a target surface 122 and a rear surface 124 opposite the target surface 122. The target surface 122 configured to face outward and away from the player 1 to which the device 100 is mounted to. The target surface 122 serves as a target 120 for the opponent to aim at when throwing a snowball 2, and the target surface 122 may act like a backboard to stop the snow 2. The target surface 122 may include graphics such as a bulls eye, logo or advertisement. The target surface 122 may be illuminated around the target perimeter region 120*a* or as a backlight to the target surface 122 to emphasize the graphics or to light the targets in dim light, or for an added dimension of fun. The rear surface 124 of the target is the surface that is located proximate the user's body (e.g., torso, or other body part), or against the user's body when worn.

The target 120 and the scoring device 100 may be formed from a variety of materials having a variety of characteristics. For example, materials may include metal, wood, plastic, fabric, any combination of these materials, or any other suitable material.

In the illustrative embodiment of FIGS. 1-4, the target 120 is depicted as rectangular in shape, but may be provided in any suitable shape, including but not limited to: a circle, triangle, pentagon, or irregular shape. The target may be flat or curved. For comfort, the target 120 may be shaped to conform to a body of a person 1, such as the torso.

As shown in FIGS. 1*a*, 1*b*, 2*a*, 2*b* and 3, the target portion 110 may include an optional permeable layer 130 that is spaced apart from the target 120. The space between the permeable layer 130 and the target 120 forming an interior region of the target portion 110. In some embodiments the permeable layer 130 may be a grate, a screen, or any other suitable construction having a plurality of openings 136. The purpose of the permeable layer 130 is to prevent players from pushing snow 2 into the device 100, and instead make the players 1 throw the snow 2, which takes much more skill.

For example, the permeable layer 130 allows snow 2 to pass through but prevents a user 1 from inserting their hand into the target portion 110 and directly shoving snow into the scoring chamber portion 150. In the case that an opponent (e.g., player 1) is able to shove some snow 2 through the permeable layer 130, as opposed to the permeable layer 130 receiving the snow 2 as a projectile, the permeable layer 130 may reduce the amount of snow 2 that makes it to the scoring chamber portion 150 as compared to if no permeable layer 130 were present.

If present, the permeable layer 130 includes an impact surface 132 and an inner surface 134 opposite the impact surface 132. The impact surface 132 is the surface of the permeable layer 130 that is configured to face outward and away from the player 1 wearing the device 100 and to be impacted by snowballs 2. The impact surface 132 is generally spaced apart from the target surface 122 along most, if not all of the device 100. The term inner surface 134 is used to describe surface of the permeable layer 130 that faces the target surface 122, so that the inner surface 134 is on the inside of the device 100.

The permeable layer 130 includes the plurality of openings 136, the openings 136 may be substantially small enough to keep the hand of an average man or woman out, but allows at least a portion of the snow to pass through. For example, the hand of an average man or woman defined as ranging between a 50% female and a 50% male in the United States. While some portion of fingers may pass through the openings 136 in the permeable layer 130, a hand holding a hand full of snow may not.

In preferred embodiments the permeable layer 130 is configured such that more of the snow 2 is allowed to pass through the permeable layer 130 than is rejected. In one such preferred embodiment the snow 2 that meets these criteria is unpacked snow, a lightly packed snowball, or moderately hand packed snowball. It is possible that an iceball or very hard packed snowball may not pass through the permeable layer 130. Snowballs of these consistencies may not pass through at all, or only a small portion may pass through.

The permeable layer 130 is shown in FIGS. 1-4 as a rectangular shape, may be provided in any suitable shape, including, for example, a circle, triangle, pentagon, irregular shape. The permeable layer 130 may be flat or curved. For comfort, the permeable layer 130 may be shaped to conform to a body of a person 1, such as the torso.

Figures 2A, 2B:
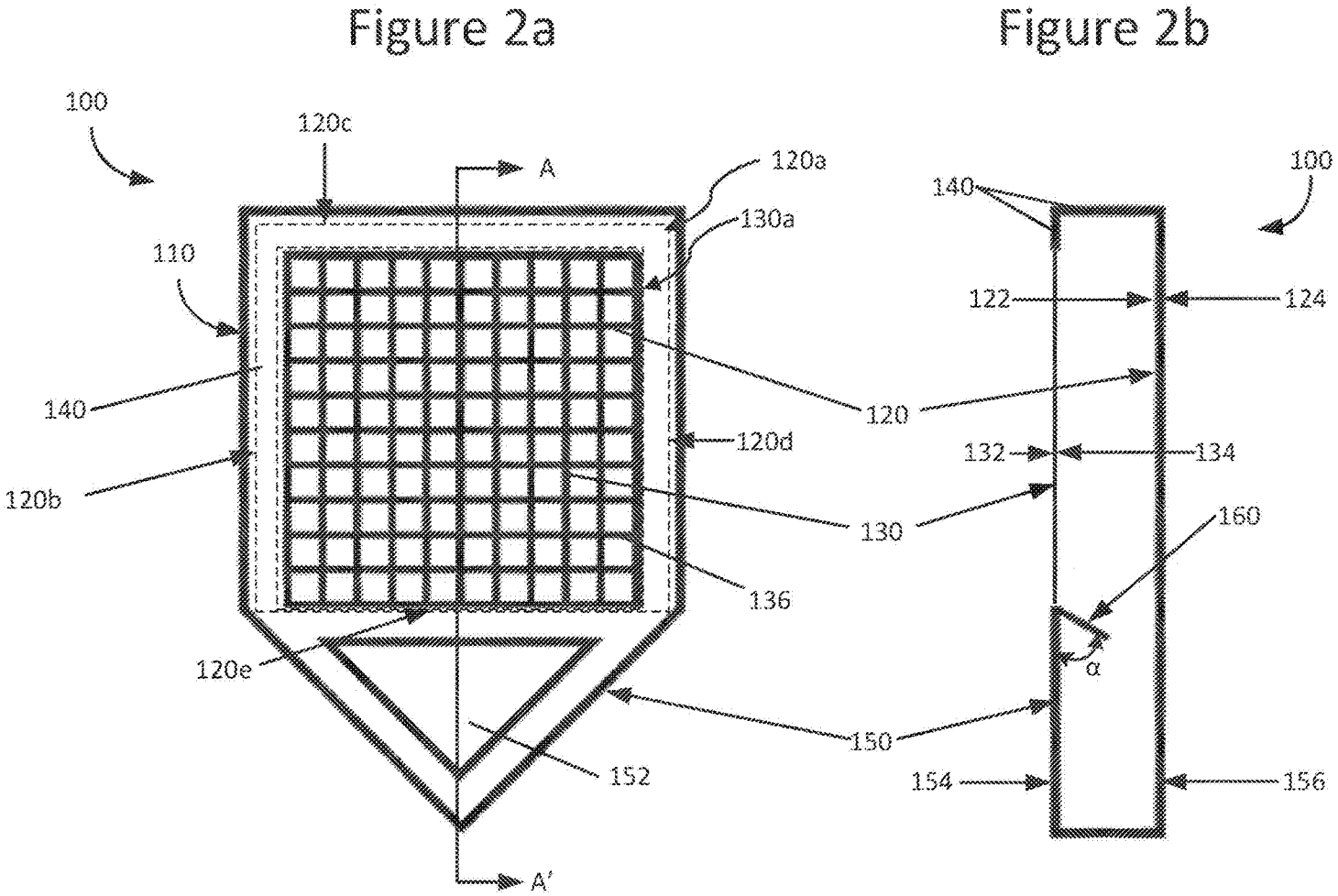
FIG. 2*a* is a front view of the scoring device according to FIGS. 1*a* and 1*b* (without attachment elements).
FIG. 2*b* is a cross-sectional view of the scoring device of FIG. 2*a* along line A-A.

In the illustrative embodiment and as shown in FIGS. 2*a* and 2*b*, the target 120 and the permeable layer 130 are spaced apart by a frame 140 extending from the perimeter region of the target 120*a* to the perimeter region of the permeable layer 130*a*. For example, the frame 140 may couple the target to the permeable layer 130 in a spaced apart relationship. The frame 140 may extend continuously around the most (more than 50%) of the entire perimeter region with the exception of an access point to allow the snow to pass along a flow path from the target portion 110 into the scoring chamber portion 150. In some embodiments, the frame 140 may extend continuously around the first, second and third sides of the perimeter regions, or only a portion of the perimeter regions 120*a*, 130*a*.

In other embodiments, instead of a frame 140, spacers may be provided at discrete locations to space the permeable layer 130 away from the target 120 without enclosing the sides of the target portion 110. This embodiment may or may not completely prevent a player's hands from shoving show into the device in between the target 120 and permeable layer 130 around the perimeter regions 120*a*, 130*a*.

In some embodiments, the frame 140 may be formed of a material, structure and/or construction similar to the permeable layer 130, such as a grate. Using a permeable material such as a grate-type structure for the frame 140 allows a greater surface area for the snow to enter the device 100 while providing the structural and spacing features of the frame 140.

Rather than providing a separate frame 140, in some embodiments the permeable layer 130 is also the frame 140. For example, rather than providing a permeable layer 130 in a flat planar shape that is spaced apart from the target 120 by the frame 140, the permeable layer 130 may be formed of a curved surface and couple to the target 120 without a frame.

Providing a curved surface, such as a u-shaped cross section with closed ends, a cupped shape, or a section of a spherical surface incorporates both the permeable features of the permeable layer 130 with the spacing apart capabilities of the frame 140.

Tailoring the appearance of the target 120 to advertise a company or other organization's logo, or to promote an event, etc., provides an additional level of customization, team spirit and fun to the game. To easily customize the device, the target 120 may be interchangeable, or a separate target visual 126 may be inserted into the device 100 and placed in front of the target surface 122. In other words, the target visual 126 may be located more distal to the user wearing the device 100 than the target 120. The target visual 126 may be proximate the target surface 122 and/or is in contact with the target surface 122. In some embodiments, the target visual 126 may be described as being between the target surface 122 and the permeable layer 130.

In other embodiments, the target visual 126 may be located proximate the inner surface 134 of the permeable layer 130. In yet another embodiment, the target visual 126 may be attached on the exterior to the device 100 and coupled to the impact surface 132 of the permeable layer 130. Attaching the target visual 126 just behind the permeable layer 130 (e.g., on the inner surface 134 as previously described), or in front of the permeable layer 130 (e.g., on the impact surface 132) where it will be impacted first, provides an additional visual assessment of the score. The target visual 126 may be made of a fragile paper that breaks easily. As the target visual 126 is broken with each hit, it becomes apparent that the player 1 has been hit, and gives an indication of whether they have been hit often and where (e.g., accuracy of the hit).

With reference to FIGS. 1-4, the scoring chamber portion 150 accumulates and stores snow that has entered the target portion 110 and is falling from the target portion 110 into the scoring chamber portion 150. For example, the snow may fall into the scoring chamber portion 150 by gravity and by the force of the snowball entering and deflecting off surfaces within the device. See, FIG. 4 which depicts a snowball hitting an embodiment of the device 100 but without a permeable layer in place.

The scoring chamber portion 150 may be formed as a chamber or box like construction of any suitable shape. The scoring chamber portion 150 may be configured to hold snow 2 disposed within the scoring chamber portion during 150 during the snowball fight.

In the illustrative embodiment of FIGS. 1-4, the scoring chamber portion 150 includes an inner wall 156 proximate the target 120 and extending away (downward) from the target 120 (co-extensive with target surface), and an outer wall 154 proximate the permeable layer 130 (if present) and extending away (downward) from the permeable layer 130. In some embodiments, including the illustrative embodiment, the inner wall 156 and the target 120 are co-planar (e.g., extending along the same plane) or in parallel or substantially parallel planes (within ±10%). Likewise, in some embodiments the outer wall 154 and the permeable layer 130 may be co-planar (e.g., extending along the same plane) or in parallel or substantially parallel planes (within ±10%). In some constructions, the target and the inner wall may be formed as a 1-piece construction. In some constructions, the permeable layer 130 and the outer wall may be formed as a 1-piece construction.

Figure 3:
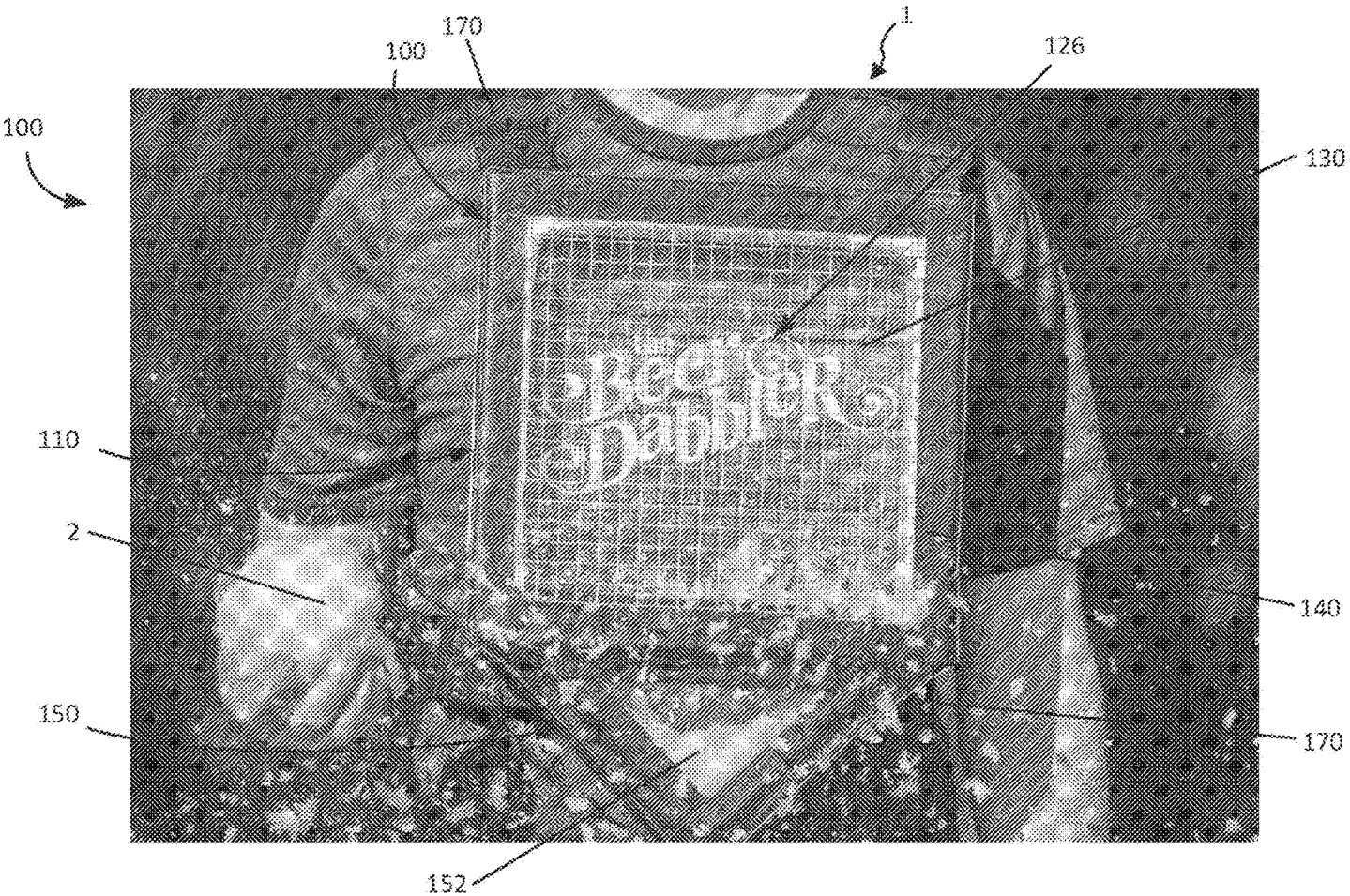
FIG. 3 is a front view of the embodiment of FIG. 1*a* after a snowball has impacted the target surface and is falling into the scoring device.
Figure 4:
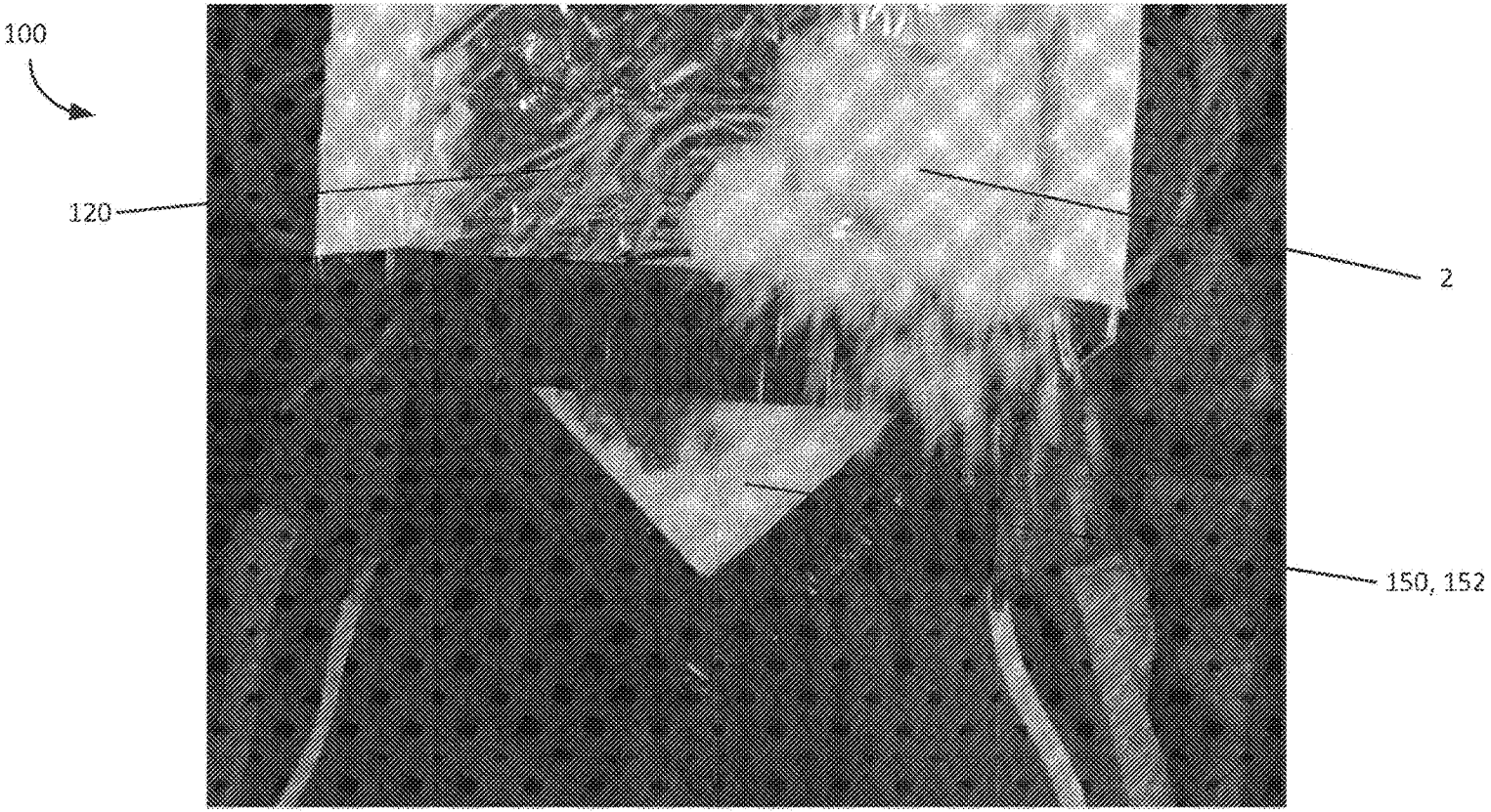
FIG. 4 is a front view of a portion of a scoring device but without the permeable layer while a snowball is impacting the target surface.

As shown in FIGS. 1*a*, 2*a* and 3, the illustrative scoring chamber portion 150 may include a window 152 on the outer wall 154 (See, FIG. 2*b*). The window 152 allows players to see how much snow has accumulated in the scoring chamber portion 150. The window 152 may be made from a translucent polymer, screen or other suitable material that retains the snow in the scoring chamber portion 150 while allowing the players to get a visual estimate of the score. The score may be determined, at least in part by the quantity of snow in the scoring chamber portion 150. The quantity that determines the score may be defined by weight or volume, a combination thereof, or any other suitable quantifiable measurement. In some embodiments graduated markings may be provided on the scoring chamber portion 150 to help estimate the quantity of snow in the scoring chamber portion 150. Some embodiments may not include a window 152, or may include a window 152 having other features.

In some variations of the illustrative embodiment not specifically depicted but easily understood by one in the art, the scoring chamber portion 150 may be made in a flexible bag-like construction or pouch. The pouch (e.g., 150) may be formed of materials such as a fabric bag, or flexible plastic sheeting such as the type garbage bags are commonly constructed from. The pouch may be removably attached to an opening at the bottom of the target portion 110. The flexible pouch may be clamped onto the target portion 110, or attached by any other suitable fixation device. In some embodiments, the scoring chamber portion 150 may be in the form of a threaded cup that screws onto a mating threaded attachment of the target portion 110. However, any suitable attachment method known in the art may be used.

In another variation of the embodiment of FIGS. 1-4, the scoring chamber portion 150 may be in the form of a threaded cup that screws onto a mating threaded attachment of the target portion 110. However, any suitable shape for the scoring chamber portion 150 and any suitable attachment method known in the art may be used.

As shown in FIG. 2*b*, the device 100 may include a stopper element 160. The stopper element 160 is provided to prevent snow that has entered the scoring chamber portion 150 from inadvertently exiting the scoring chamber portion 150. The stopper element 160 prevents, reduces or limits the snow from coming back up out of the scoring chamber portion 150 and out of the device 100 when the player 1 is running, bending over to get snow to make a snowball, and any other motion. The stopper element 160 may be located at the junction between the target portion 110 and the scoring chamber portion 150. However, the stopper element 160 can be at any location in the flow path that the snow 2 travels in the device 100. The flow path being the path between entering the target portion 110 and a location in the scoring chamber portion 150.

The stopper element 160 may be provided in many forms. As perhaps best shown in FIGS. 2*a* and 2*b*, the stopper element 160 may be a fixed element extending along a stopper plane from a first side 120*b* to a second side 120*d* (e.g., at least a portion of the distance from the first side 120*b* to the second side 120*d*). In the illustrative embodiment of FIGS. 2*a* and 2*b*, the stopper element 160 extends a portion of the distance across the flow path and is angled downwards to inhibit the snow from exiting the scoring chamber portion 150. The angle $\alpha$ between the stopper and the outer wall may be an acute angle (less than 90 degrees). In a preferred embodiment the angle $\alpha$ may be less than 75 degrees. In some embodiments, the stopper element 160 may take on other geometries but maintain the downward angled form. In some embodiments the stopper element 160 is hingeable to move out of the way as snow falls into the scoring chamber portion 150 but includes a spring to return the stopper element 160 to its original position. In other embodiments, the stopper element 160 may extend, not at an acute angle, but perpendicular to the outer wall 154 and/or inner wall 156. For example, in the case where the outer and inner walls 154, 156 are parallel, or substantially parallel (e.g., within 10%), the stopper element 160 may extend at least a portion of the distance straight across from the outer wall 154 to the inner wall 156 at an angle that is substantially perpendicular to the outer and inner walls 154, 156. These examples are not limiting, any arrangement of a stopper element 160 that creates a more tortuous path to prevent the flow of snow out of the scoring chamber portion 150 may be provided.

In some embodiments, there may be two or more stopper elements 160. The inclusion of multiple stopper elements 160 may make it harder for snow 2 to be inadvertently dislodged from the scoring chamber portion 150 to the target portion 110, and exit out of the device 100.

Figure 1B:
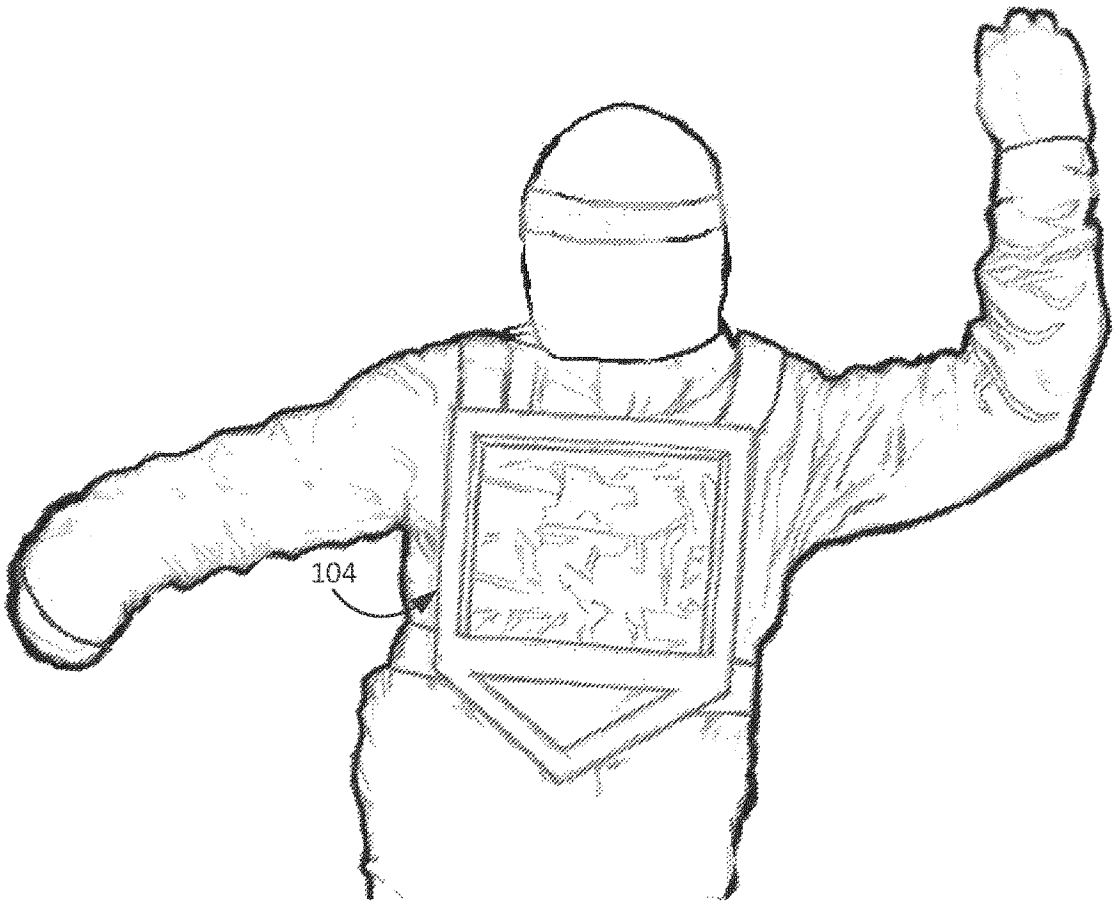
FIG. 1*b* is a rear view of the embodiment of FIG. 1*a* including an optional feature of the scoring device worn by a person.

In some embodiments, and as shown in the combination of FIGS. 1*a* and 1*b*, the device may include more than one scoring device 100 (e.g., the scoring device 100 including a target portion 110 and scoring chamber portion 150). A first or front scoring device 102 as shown in FIG. 1*a* may be used alone or together with a second or rear scoring device 104 as shown in FIG. 1*b*. In some embodiments, the rear scoring device 100 may be used alone without the front scoring device 100.

In some embodiments, at least portions of the device 100, such as the scoring chamber portion 150 may be insulated to prevent the snow 2 from melting in warm environments. In some embodiments, the scoring chamber portion 150 may be water-tight to prevent the loss of melted snow.

As shown in FIGS. 1*a* 1*b*, the device 100 may include one or more attachment elements 170. The attachment element(s) may be configured to attach the device 100 to a person 1. As shown in the illustrative embodiment of FIG. 1*a*, the attachment elements 170 may be straps or ropes that wrap around a portion of a person 1, such as a torso of the person 1. Here, the front scoring device 100 is shown proximate the front torso of the person 1. In some embodiments of the device, and as shown in FIG. 1*b*, the attachment elements 170 may also connect to the rear scoring device 100 (if provided). The attachment elements 170 may be arranged and configured to locate the rear scoring device 100 proximate the rear torso of the person 1.

While the device is shown as being attached to the torso of a person 1, in some embodiments the attachment elements 170 are configured to be attached to other objects, including structures such as posts, forts, snow forts, trees, decks, fences, walls, nets, basketball hoops, or any other suitable structure.

In the illustrative embodiment of FIGS. 1-4, the one or more attachment elements 170 are provided in the form of straps. In other embodiments the attachment element(s) may be a vest, shirt, jacket, or protective wear that the target portion 110 and scoring chamber portion 150 are coupled to or incorporated into.

In some embodiments, as may be appropriate in the case where the device 100 is couplable to a structure rather than a person, the one or more attachment elements may be fixation elements such as a screws, bolts, ropes or tie strap attachments; or a hole to be used with a screw, bolt, rope, or tie strap attachment. The attachment elements may be any suitable attachment element, as is known to those in the art.

Some embodiments of the device 100 and method 500 may be used in an application other than snow in a snowball fight. The snow 2 may be snowflakes in the form of frozen water as is naturally occurring in nature. The snow used to play the game and referred to in this disclosure is generally of the consistency that it may be packed together and formed into a snowball, but is not refrozen in to a solid snowball or iceball to the point that it cannot be broken during the course of a typical snowball fight.

The scoring media 2 is not limited to snow 2, and the scoring device 100 is not limited to only snowball fights with snow. Snow 2 may include other natural or artificial representations of snow, including other materials with compositions or characteristics suitable for use with the scoring device 100. For example, scoring media 2 that is capable of being formed into a ball, thrown as a projectile, and broken upon impact with the device falls within the scope of this disclosure.

Scoring media 2 equivalents to naturally occurring snow may include, for example, man-made snow, artificial snow, snow substitutes, mud/dirt, any organic media including food having a mashed potato consistency or gelatin consistency, gels, wood pulp, or any other suitable material.

Figure 5:
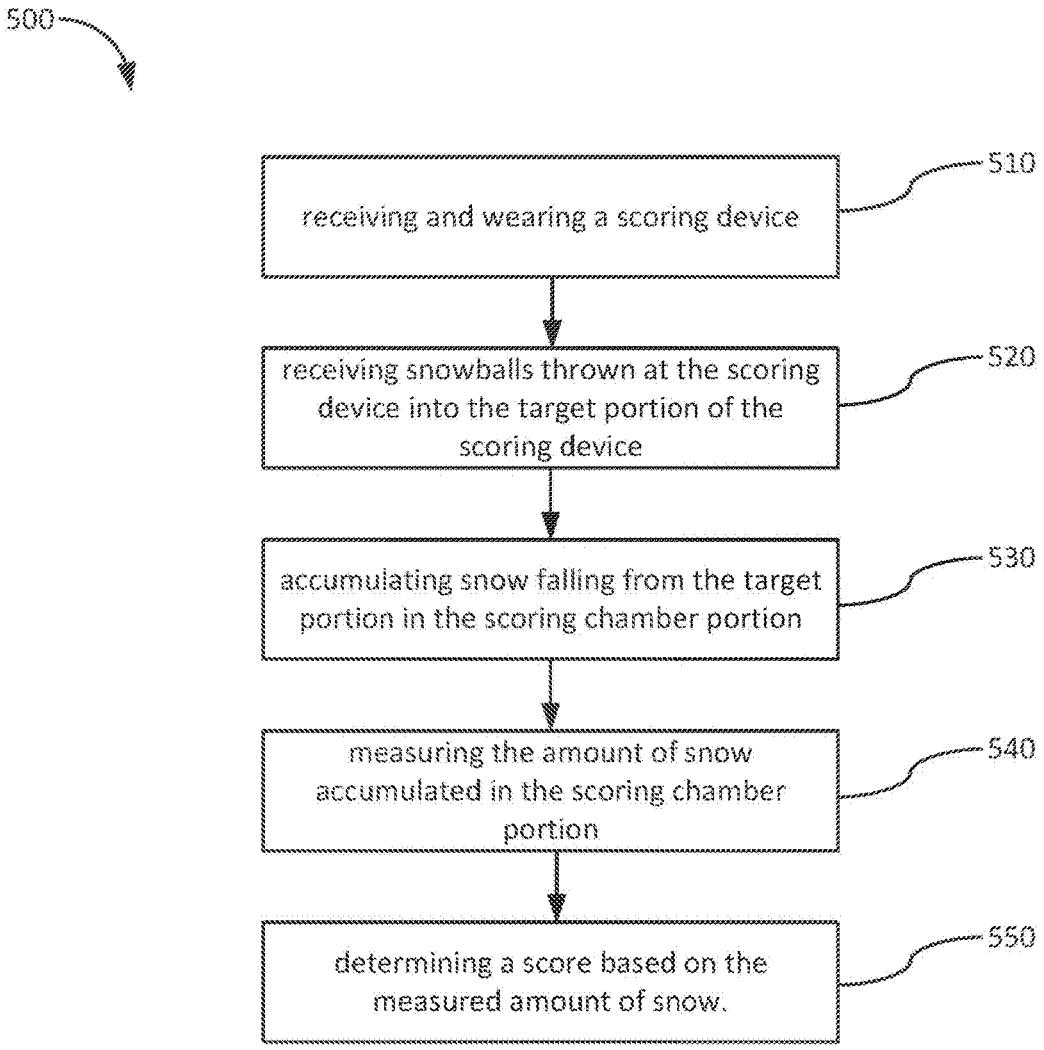
FIG. 5 is a flow chart of a method of scoring a snowball fight.

FIG. 5 is a flow chart illustrating an example method 500 of a scoring a snowball fight. Such a method may be used with, but is not limited to, the scoring device 100 described above and illustrated in FIGS. 1-4. With reference to FIG. 5, the method 500 may include: receiving and wearing the scoring device (step 510); receiving snowballs thrown at the scoring device 100 such that snow from the snowballs enters the target portion (step 520). The method 500 further includes accumulating snow falling from the target portion into the scoring chamber portion (step 530). Finally, the method 500 includes measuring the amount of snow accumulated in the scoring chamber portion (step 540), and determining a score (550).

In some embodiments of the method, step 540, including the measuring step, may also include removing the snow that has accumulated in the scoring chamber, or any residual snow in the target portion in order to measure the quantity of snow. This may include turning the device over and shaking the snow out of the device, or opening an access point to access and remove the snow. For example, the scoring chamber portion may be removable from the target portion or an access point such as a door, port or opening in the scoring chamber portion may be provided. The quantity of snow may be measured as the volume, weight, or any other suitable quantifiable characteristic.

In an embodiment of a method for a team snowball fight, each player wears a scoring device and the quantity of snow in each scoring device of all the team members is added together to determine a team score. Scoring may also be done on an individual player basis to determine a ranking of individual players.

Illustrative embodiments of scoring devices and methods of scoring a snowball fight (or related and equivalent types of scoring media 2) have been set forth, and reference has been made to some possible variations. These and other variations and modifications of the invention will be apparent to those skilled in the art without departing from the scope of the invention, and it should be understood that this invention is not limited to the illustrative embodiments set forth herein.

Various examples have been described. These and other examples are within the scope of the following claims.

The invention claimed is:

1. A scoring device to be worn by a person for scoring a snowball fight, the device comprising:

a target portion including:

a target, a permeable layer spaced apart from the target, an interior region, including a scoring chamber, positioned between the permeable layer and the target, the interior region being substantially continuous without any openings; and the scoring chamber portion positioned at the bottom of the interior region when the scoring device is worn by the person, the scoring chamber portion arranged to accumulate and store snow falling from the interior region the scoring device except the permeable layer being substantially fluid-tight such that when snow passes through the permeable layer, snow is collected in the scoring chamber and prevented from leaving the scoring device.

2. The device of claim 1, comprising a second device according to the device of claim 1, wherein the device is configured to be coupled proximate the front of the torso of the person, and the second device is configured to be coupled proximate the rear of the torso of the person.

3. The device of claim 1, wherein the permeable layer is coupled to the target by a frame extending around at least a portion of the perimeter region of the target and the perimeter region of the permeable layer.

4. The device of claim 1, wherein the permeable layer is a grate.

5. The device of claim 1, wherein the permeable layer prevents the snow from being directly inserted into the scoring chamber portion by an opponent.

6. The device of claim 1, wherein the target has a target surface.

7. The device of claim 1, wherein the scoring chamber portion includes graduated markings that visually depict the amount of snow that has accumulated in the scoring chamber portion to provide a visual assessment of the score.

8. The device of claim 1, further comprising a stopper at least partially separating the target portion from the scoring chamber portion, wherein the stopper is shaped and arranged to allow snow to enter the scoring chamber portion but limits the amount of snow that exits the scoring chamber portion when the person bends over.

9. The device of claim 1, wherein the scoring chamber portion includes a window configured to permit snow that accumulates in the scoring chamber portion to be viewed.

10. The scoring device of claim 1, further comprising a stopper at least partially separating the target portion from the scoring chamber portion, wherein the stopper is shaped and arranged to allow snow to enter the scoring chamber portion but limits the amount of snow that exits the scoring chamber portion when the person bends over.

11. The scoring device of claim 1, wherein edges of each of the interior region and the scoring chamber are generally continuous, such that snow entering the interior region and the scoring chamber remains within the scoring device.

12. The scoring device of claim 1, wherein the scoring chamber comprises a bottom wall generally perpendicular to a plane along which the permeable layer is disposed.

13. The scoring device of claim 1, wherein the scoring chamber being thermally insulated to prevent snow from melting.

14. The scoring device of claim 10, wherein the stopper being movable from an original position to a new position in a hinged manner so as to permit entry of snow falling into the scoring chamber portion, the stopper being spring-biased to return to the original position from the new position.

* * * * *